US008454022B1

(12) United States Patent
Zou

(10) Patent No.: US 8,454,022 B1
(45) Date of Patent: Jun. 4, 2013

(54) SINGLE, COLOR-CODED GAME SET FOR PLAYING MULTIPLE GAMES

(76) Inventor: Qinghua Zou, Issaquah, WA (US)

( * ) Notice: Subject to any disclaimer, the term of this patent is extended or adjusted under 35 U.S.C. 154(b) by 0 days.

(21) Appl. No.: 13/423,123

(22) Filed: Mar. 16, 2012

(51) Int. Cl.
*A63F 3/00* (2006.01)

(52) U.S. Cl.
USPC ..... 273/283; 273/287

(58) Field of Classification Search
USPC ..... 273/283, 287
See application file for complete search history.

(56) References Cited

U.S. PATENT DOCUMENTS 3,034,517 A * 5/1962 Reiland ..... 453/29
3,866,921 A * 2/1975 Klock ..... 273/139
4,059,274 A * 11/1977 Samson et al. ..... 273/265
4,241,923 A * 12/1980 Meirovitz ..... 273/265
2009/0278312 A1* 11/2009 Bower ..... 273/243

* cited by examiner

*Primary Examiner* — Vishu K. Mendiratta
(74) *Attorney, Agent, or Firm* — Plager Schack LLP

(57) ABSTRACT

A game set for education and amusement includes a plurality of large cylindrical game pieces of nine different colors and a plurality of small game pieces of nine different colors preferably corresponding to the nine colors of the large game pieces. Pieces of a given color are also provided with a corresponding number selected from one through nine on one side. All pieces of a given color share the same numerical indicia. Large game pieces also include either a white or a black mark on a second side. A game board includes eighty-one depressions formed therein having a cylindrical shape corresponding to that of the eighty-one large pieces. A customized tray allows for holding all game pieces. An instruction manual containing written instructions for playing Sudoku, Checkers and Go using the large and small pieces and the game board is also provided.

9 Claims, 3 Drawing Sheets

SINGLE, COLOR-CODED GAME SET FOR PLAYING MULTIPLE GAMES

BACKGROUND OF THE INVENTION

The present invention relates to the three known board games Sudoku, Go and American checkers.

Sudoku is a number-placement puzzle the objective of which is to fill 9×9 grids such that each row, column and each 3×3 matrix contains all digits from 1 to 9. The puzzle starts with a partially completed 9×9 grid which generally has a unique solution.

Go is a 2000 year old game in which two players alternately place black and white pieces of a 19×19 grid. The object of the game is for a player to surround a larger portion of the board with one's pieces than the opposing player. When a chain of pieces is surrounded by opposing pieces, the chain is captured by the opposing pieces.

American checkers is played with twenty-four game pieces of two different colors on an board having 8×8 squares of alternating color. Pieces move diagonally from a square of one color to a square of the same color.

Known Sudoku boards are not child-friendly. They do not facilitate logical thinking steps and team work. Additionally, known Sudoku boards lack color-coding, small place-holder pieces and simple depressions for holding large pieces in a horizontally arrested position. Current square depressions require lining up corners for placement. A suitable box for holding the game pieces in an organized, easy-to-access fashion is also lacking.

It has been shown that color coding attracts the attention of learners to perceptually salient information. Studies also suggest color coding increases retention. No color-coded Sudoku board games are known. Working two parts of the brain together with digits and color in Sudoku provides exercise for different parts of the brain.

The standard Go board of 19×19 positions requires too much time to finish a game. A board with less positions will reduce the loss of interest of players as games drag on.

Presently, no known board game system integrates board sets for the games Sudoku, Go and Checkers.

SUMMARY OF THE INVENTION

The present invention is child-friendly. Sudoku thinking steps are facilitated by the inclusion of numbered and colored small game pieces to hold the place of a potential large game piece while the player is considering possibilities. Small, place holder pieces are provided to replace scratch writing of guessed numerical values. Accordingly, paperless arithmetic is easier.

Child-friendly colors are used to identify 3×3 blocks on the game board of the present invention.

Simple, circular depressions in the game board of the present invention allow receipt of large cylindrical game pieces to hold the large game pieces in place and prevent sliding out of position. Because of the circular base of large game pieces, a child may easily place a large game piece into a depression without lining up any corners.

A provided box tray organizes big pieces into nine cells. Each cell holds nine large game pieces in 3×3 groups with a small separator. Nine additional cells provide for receipt of small game pieces and have a smooth curved interior making fetching small pieces easy.

The game board according to the present invention allows for play of a simpler 9×9 game of Go to reduce game time.

The present invention integrates the games Sudoku, Checker and Go in a single board.

According to one benefit of the present invention a parent may play Sudoku with their children to supervise their thinking and ruling. Alternatively, a single player may play alone. Another benefit of the present invention is it provides social interaction and cooperation through groups of players solving Sudoku puzzles together. According to the present invention, two- or four-player checkers may be played. With two or more game sets according to the present invention, two or more groups may compete by solving the same puzzle on the two or more provided game sets in the fastest time. Furthermore, the game set allows for two players to play a 9×9 Go game.

DETAILED DESCRIPTION OF THE INVENTION

Figure 1:
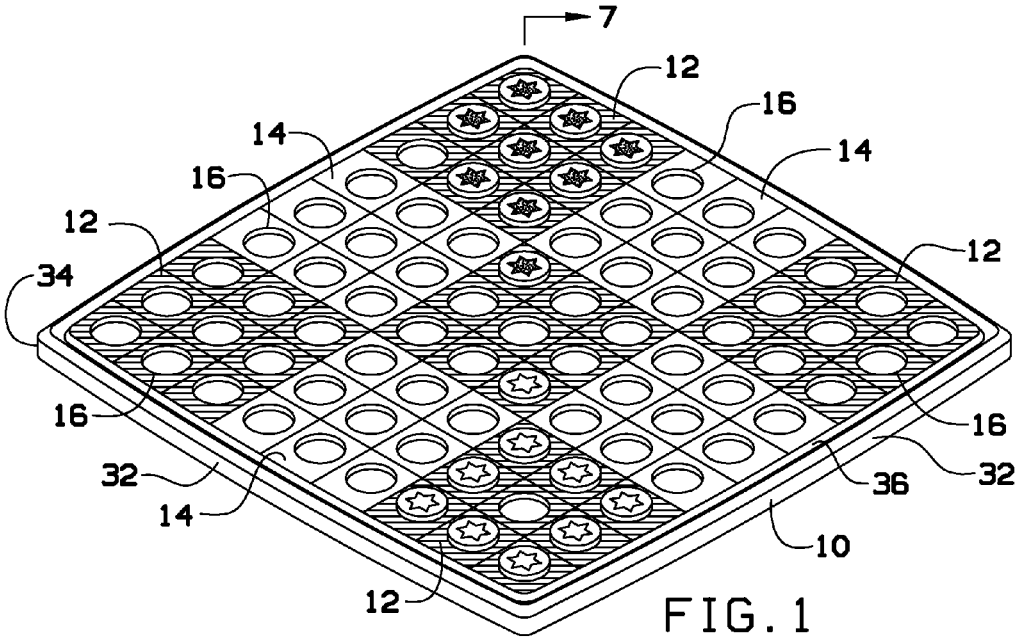
FIG. 1 illustrates a perspective view of the present invention in use.
Figure 2:
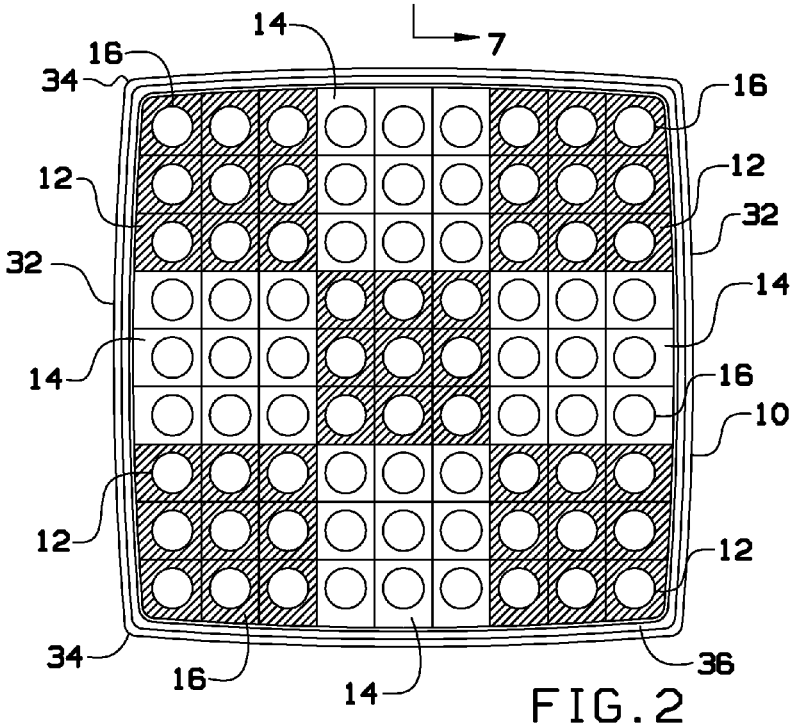
FIG. 2 illustrates a top view of a game board in accordance with the present invention.

The game set of the present invention comprises eighty-one large game pieces 18 having a generally cylindrical shape and comprising first and second sides or circular bases of equal diameter, a game board 10 having eighty-one depressions 16 therein for receiving the eighty-one large game pieces 18 and also including nine regions 12 and 14 within the game board 10; 135 small game pieces 20; a tray 26 for containing large 18 and small game pieces 20; an instruction manual containing written instructions for playing Sudoku, checkers and go using large pieces 18, small pieces 20, game board 10 and said nine regions 12 and 14.

Figure 3:
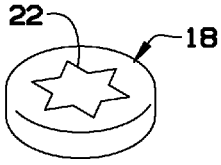
FIG. 3 illustrates a bottom perspective view of a large game piece in accordance with the present invention.
Figure 4:
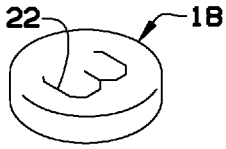
FIG. 4 illustrates a top perspective view of the large game piece of FIG. 3.
Figure 10:
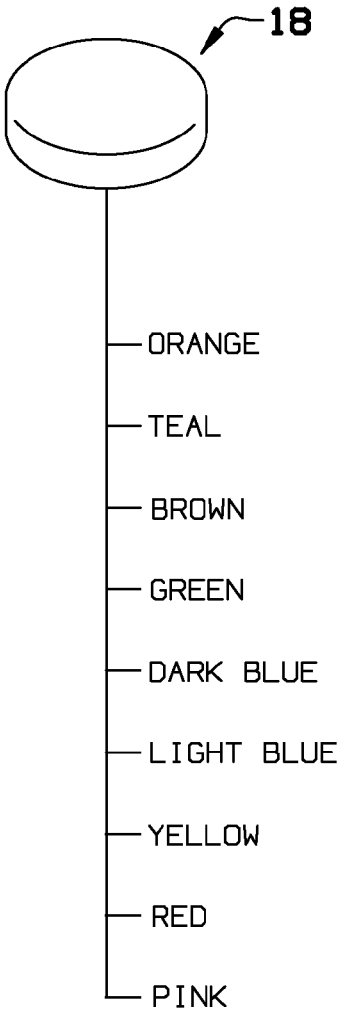
FIG. 10 illustrates another perspective view of the large game piece in accordance with the present invention.
Figure 11:
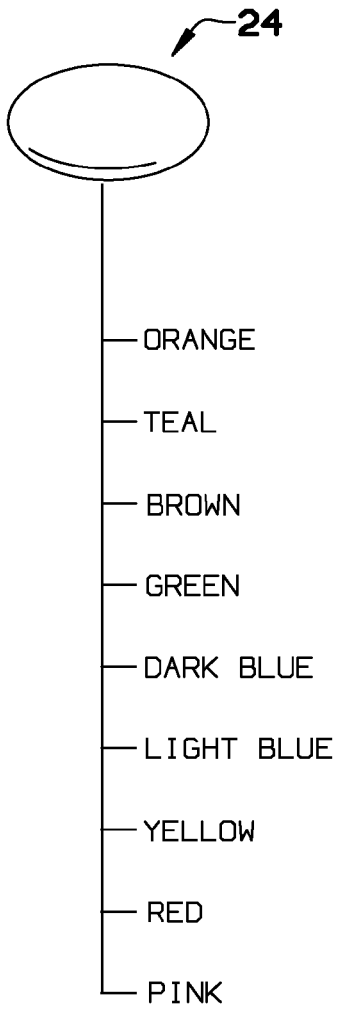
FIG. 11 illustrates another perspective view of the small game piece in accordance with the present invention.

The eighty-one large game pieces 18 are divided into groups of nine large game pieces 18 such that each group of nine large game pieces 18 is of a different color. Preferred colors include orange, teal, brown, green, dark blue, light blue, yellow, red, and pink as indicated in FIG. 10. Within each color group, all of the pieces 18 are labeled on one side with indicia representing the numbers 1-9 as seen in FIG. 4. In this way, for example, all of the large orange pieces include indicia corresponding to the number '1', all of the large teal pieces include indicia corresponding to the number '2', etc. Furthermore, as viewed in FIG. 3, forty-one of said large game pieces 18 include a white mark, preferably in the form of a star, on a side opposite of that including the numerical indicia and forty include a black mark, preferably in the form of a star, on this same opposite side.

Figure 7:
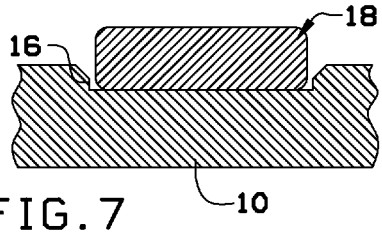
FIG. 7 illustrates a section detail view of the invention along line 7-7 in FIG. 1.
Figure 8:
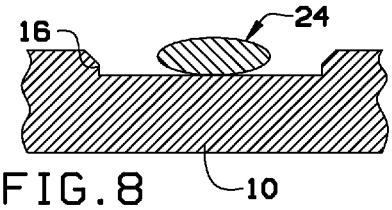
FIG. 8 illustrates a section detail view of the invention similar to that depicted by FIG. 7 except with a small game piece rather than large.
Figure 9:
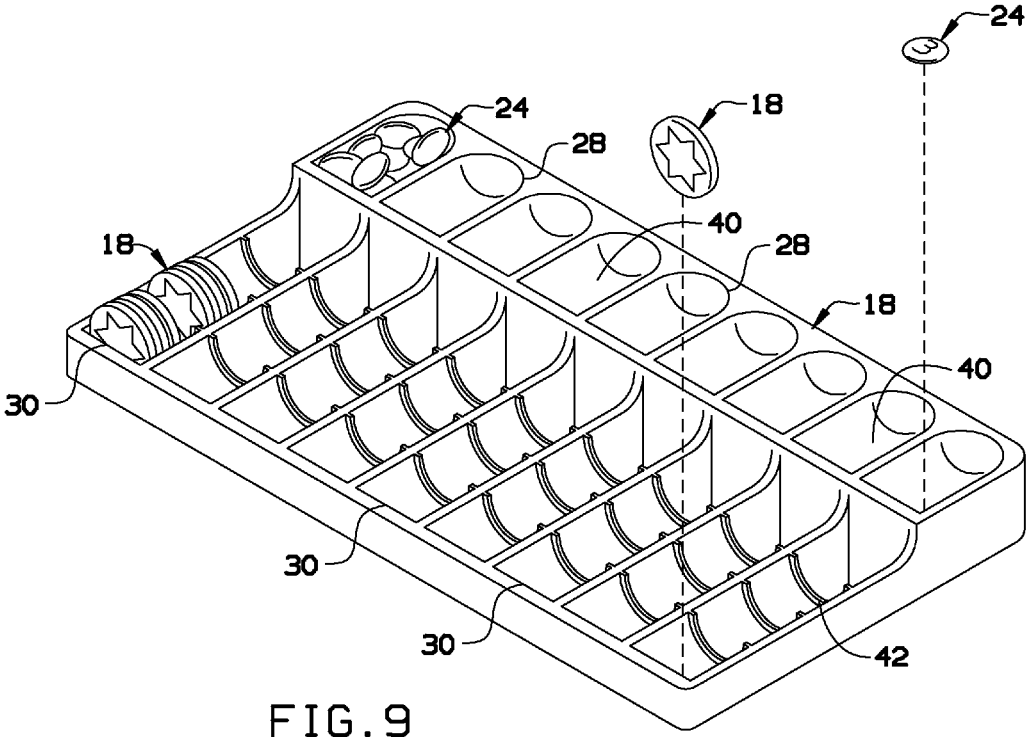
FIG. 9 illustrates a perspective exploded view of the game piece tray in accordance with the present invention.

The nine regions 12 and 14 of the game board 10 each include nine of the eighty-one depressions 16 arranged in a 3×3 matrix. Five of said nine regions 12 are shaded a first color and four of the nine regions 14 are shaded a second color. The eighty-one depressions 16 have a cylindrical shape corresponding to that of the eighty-one large pieces such that the respective diameters are approximately equal. This correspondence in circumference prevents large pieces from sliding horizontally along the board 10 surface so that large pieces remain organized. As viewed in FIG. 7, the depth of the depressions 16 is less than the height of a large game piece 18 to facilitate removal of large game pieces 18 from depressions 16. In some embodiments, the ratio of height to depth is greater than 2 to 1 and may be 3 to 1. As seen in FIG. 8, small game pieces 20 also fit into the depressions 16 to allow for place holding while planning a Sudoku move with one of the large game pieces 18. Game board 10 as seen in FIG. 1, also includes rounded corners 34, curved edges 32 and small, concaved separator line 36.

Figure 5:
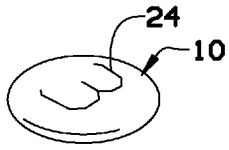
FIG. 5 illustrates a top perspective view of a small game piece in accordance with the present invention.
Figure 6:
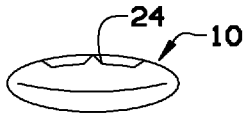
FIG. 6 illustrates a side perspective view of the small game piece of FIG. 5.

The small game pieces 20 are divided into groups of fifteen small pieces 20 such that each group of fifteen is of a different color. It is preferable that each of the nine color groups corresponds to one of the large game piece colors. Within each color group, all of the fifteen small pieces 20 are numbered with indicia representing the numbers 1-9 as seen in FIGS. 5 and 6, such that, for example, all of the small orange pieces include indicia corresponding to the number '1', all of the small teal pieces include indicia corresponding to the number 7, etc. These small pieces 20 have an ovular cross-section as well as a circular perimeter as evident from FIGS. 5 and 6.

The tray 26 includes nine large receptacles 30 and nine small receptacles 28. Each of large receptacles 30 are of a generally half-cylindrical configuration and are divided into three sections by restrictions 42 in the diameter of the half-cylindrical configuration. Each large receptacle 30 is also shaped and configured to receive nine of said large game pieces 18 such that three sets of three of said large game pieces 18 are grouped according to said restrictions 42. The restrictions 42 help to stabilize the large game pieces 18 in a position in which their top and bottom sides are generally perpendicular to the longitude of the half-cylinders represented by the large receptacles 30. Each of the small receptacles 28 is configured to hold 15 of said small game pieces 20 and includes curved sloping edges to facilitate dragging one or more small pieces 20 from the small receptacles 28.

Finally, an instruction manual containing written instructions for playing Sudoku, Go and Checkers using large pieces, small pieces, game board 10 and the nine regions is provided with the other components. The instruction manual describes the set-up for ten different levels of Sudoku play each of which having ten different games for a total of one hundred pre-defined games at ten different levels. Difficulty of game level may be determined from a number of factors including but not limited to the number of pieces used to set up a game and the kind of reasoning strategy involved to solve a particular game. A set up with more pieces, for example, will generally be considered less difficult than a set up with fewer pre-placed pieces.

To use the game to play Sudoku, a number of large game pieces 18 are placed into a number of depressions 16 to set the known cells of the game. Players subsequently make educated guesses as to solutions by placing one or more small pieces 20 into one or more depressions 16 to hold the places where large game pieces 18 may be placed later. When a small game piece 20 has been verified, it is replaced by a large game piece 18. Once all depressions 16 of the game board 10 have been filled with large game pieces 18, the Sudoku game concludes.

To use the game to play Go, players progressively place large game pieces 18 with their white or black marked sides 22 facing up. Since there are eighty-one depressions 16, a Go game may be up to a size of 9×9.

Finally, two- or four-player checkers games are supported by the large game pieces 18 and game board 10. Two players place nine large game pieces 18 into the nine depressions 16 at opposing corners with white and black marked sides 22 facing up as shown in FIG. 1. The game may now proceed in a way similar to American Checkers except that large game pieces 18 are permitted to move into any adjacent depression according to rules provided in the included instruction manual. The large game pieces may move along rows, columns or diagonally during play. For faster movement and to capture large game pieces 18 of the opposing team, jumping one's large game pieces 18 over those of another is also permitted.

In some embodiments, stickers may be provided.

In some embodiments, the game set may be provided without an instruction manual.

While the present invention has been described according to physical embodiments of a game board as well as large and small pieces, providing each of these elements in virtual forms in an electronic game may be found desirable.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

I claim:

1. A game set for education and amusement, comprising:

eighty-one large game pieces having a generally cylindrical shape and comprising first and second circular bases of equal diameter;

wherein nine of said eighty-one large game pieces comprise a first color, nine of said eighty-one large game pieces comprise a second color, nine of said eighty-one large game pieces comprise a third color, nine of said eighty-one large game pieces comprise a fourth color, nine of said eighty-one large game pieces comprise a fifth color, nine of said eighty-one large game pieces comprise a sixth color, nine of said eighty-one large game pieces comprise a seventh color, nine of said eighty-one large game pieces comprise an eighth color and nine of said eighty-one large game pieces comprise a ninth color;

wherein said large game pieces of said first color include indicia corresponding to the number '1', said large game pieces of said second color include indicia corresponding to the number '2', said large game pieces of said third color include indicia corresponding to the number '3', said large game pieces of said fourth color include indicia corresponding to the number '4', said large game pieces of said fifth color include indicia corresponding to the number '5', said large game pieces of said sixth color include indicia corresponding to the number '6', said large game pieces of said seventh color include indicia corresponding to the number '7', said large game pieces of said eighth color include indicia corresponding to the number '8' and said large game pieces of said ninth color include indicia corresponding to the number '9';

wherein forty-one of said large game pieces include a white mark on said first bases;

wherein forty of said large game pieces include a black mark on said first bases;

a game board having a single playing side with eighty-one depressions therein for receiving said eighty-one large game pieces;

nine regions within the game board wherein each of said nine regions includes nine of said eighty-one depressions arranged in a 3×3 matrix;

wherein five of said nine regions comprise a first color and four of said nine regions comprise a second color;

135 small game pieces;

wherein fifteen of said 135 small game pieces comprise said first color, fifteen of said 135 small game pieces comprise said second color, fifteen of said 135 small game pieces comprise said third color, fifteen of said 135 small game pieces comprise a fourth color, fifteen of said 135 small game pieces comprise said fifth color, fifteen of said 135 small game pieces comprise said sixth color, fifteen of said 135 small game pieces comprise said seventh color, fifteen of said 135 small game pieces comprise said eighth color and fifteen of said 135 small game pieces comprise said ninth color;

wherein said small game pieces of said first color include indicia corresponding to the number '1', said small game pieces of said second color include indicia corresponding to the number '2', said small game pieces of said third color include indicia corresponding to the number '3', said small game pieces of said fourth color include indicia corresponding to the number '4', said small game pieces of said fifth color include indicia corresponding to the number '5', said small game pieces of said sixth color include indicia corresponding to the number '6', said small game pieces of said seventh color include indicia corresponding to the number '7', said small game pieces of said eighth color include indicia corresponding to the number '8' and said small game pieces of said ninth color include indicia corresponding to the number '9';

a tray for containing said large game pieces and said small game pieces, said tray comprising nine large receptacles and nine small receptacles;

wherein said large receptacles are of a generally half-cylindrical configuration and comprise three sections designated by restrictions in the diameter of the cylindrical configuration and each of said large receptacles is configured to receive nine of said large game pieces such that three sets of three of said large game pieces are grouped according to said restrictions;

wherein each of said small receptacles is configured to hold fifteen of said small game pieces;

an instruction manual containing written instructions for playing sudoku, checkers and go using said large pieces, said small pieces, said game board and said nine regions, wherein said games may all be played on said single playing side of said game board using substantially the same game pieces to play each said game.

2. A game set for education and amusement, comprising:

eighty-one large game pieces having a generally cylindrical shape defining a height and comprising first and second circular bases of equal diameter;

a game board having a single playing side with eighty-one depressions therein for receiving said eighty-one large game pieces and comprising nine regions within the game board;

said eighty-one depressions have a cylindrical shape corresponding to that of the eighty-one large pieces such that the respective diameters are approximately equal and the depth of the depressions are less than the height of the large pieces;

135 small game pieces;

a tray for containing said large game pieces and said small game pieces, said tray comprising nine large receptacles and nine small receptacles;

wherein said large receptacles are of a generally half-cylindrical configuration and comprise three sections designated by restrictions in the diameter of the cylindrical configuration and each of said large receptacles is configured to receive nine of said large game pieces such that three sets of three of said large game pieces are grouped according to said restrictions;

wherein each of said small receptacles is configured to hold fifteen of said small game pieces;

an instruction manual containing written instructions for playing sudoku, checkers and go using said large pieces, said small pieces, said game board and said nine regions, wherein said games may all be played on said single playing side of said game board using substantially die same game pieces to play each said game.

3. The game as set forth in claim 2, wherein:

nine of said eighty-one large game pieces comprise a first color, nine of said eighty-one large game pieces comprise a second color, nine of said eighty-one large game pieces comprise a third color, nine of said eighty-one large game pieces comprise a fourth color, nine of said eighty-one large game pieces comprise a fifth color, nine of said eighty-one large game pieces comprise a sixth color, nine of said eighty-one large game pieces comprise a seventh color, nine of said eighty-one large game pieces comprise an eighth color and nine of said eighty-one large game pieces comprise a ninth color.

4. The game as set forth in claim 3, wherein:

on the respective first circular bases, said large game pieces of said first color include indicia corresponding to the number '1', said large game pieces of said second color include indicia corresponding to the number '2', said large game pieces of said third color include indicia corresponding to the number '3', said large game pieces of said fourth color include indicia corresponding to the number '4', said large game pieces of said fifth color include indicia corresponding to the number '5', said large game pieces of said sixth color include indicia corresponding to the number '6', said large game pieces of said seventh color include indicia corresponding to the number '7', said large game pieces of said eighth color include indicia corresponding to the number '8' and said large game pieces of said ninth color include indicia corresponding to the number '9'.

5. The game as set forth in claim 4, wherein:

41 of said large game pieces include a white mark on said second circular bases and 40 of said large game pieces include a black mark on said second circular bases.

6. The game as set forth in claim 2, wherein:

each of said nine regions includes nine of said eighty-one depressions arranged in a 3×3 matrix;

wherein five of said nine regions comprise a first color and four of said nine regions comprise a second color.

7. The game as set forth in claim 2, wherein:

fifteen of said 135 small game pieces comprise said first color, fifteen of said 135 small game pieces comprise said second color, fifteen of said 135 small game pieces comprise said third color, fifteen of said 135 small game pieces comprise a fourth color, fifteen of said 135 small game pieces comprise said fifth color, fifteen of said 135 small game pieces comprise said sixth color, fifteen of said 135 small game pieces comprise said seventh color, fifteen of said 135 small game pieces comprise said eighth color and fifteen of said 135 small game pieces comprise said ninth color.

8. The game as set forth in claim 7, wherein:

said small game pieces of said first color include indicia corresponding to the number '1', said small game pieces of said second color include indicia corresponding to the number '2', said small game pieces of said third color include indicia corresponding to the number '3', said small game pieces of said fourth color include indicia corresponding to the number '4', said small game pieces of said fifth color include indicia corresponding to the number '5', said small game pieces of said sixth color include indicia corresponding to the number '6', said small game pieces of said seventh color include indicia corresponding to the number '7', said small game pieces of said eighth color include indicia corresponding to the number '8' and said small game pieces of said ninth color include indicia corresponding to the number '9'.

9. The game as set forth in claim 2, wherein:

nine of said eighty-one large game pieces comprise a first color, nine of said eighty-one large game pieces comprise a second color, nine of said eighty-one large game pieces comprise a third color, nine of said eighty-one large game pieces comprise a fourth color, nine of said eighty-one large game pieces comprise a fifth color, nine of said eighty-one large game pieces comprise a sixth color, nine of said eighty-one large game pieces comprise a seventh color, nine of said eighty-one large game pieces comprise an eighth color and nine of said eighty-one large game pieces comprise a ninth color;

on the respective first circular bases, said large game pieces of said first color include indicia corresponding to the number '1', said large game pieces of said second color include indicia corresponding to the number '2', said large game pieces of said third color include indicia corresponding to the number '3', said large game pieces of said fourth color include indicia corresponding to the number '4', said large game pieces of said fifth color include indicia corresponding to the number '5', said large game pieces of said sixth color include indicia corresponding to the number '6', said large game pieces of said seventh color include indicia corresponding to the number '7', said large game pieces of said eighth color include indicia corresponding to the number '8' and said large game pieces of said ninth color include indicia corresponding to the number '9';

41 of said large game pieces include a white mark on said second circular bases and 40 of said large game pieces include a black mark on said second circular bases;

each of said nine regions of said game board includes nine of said eighty-one depressions arranged in a 3×3 matrix, wherein five of said nine regions comprise a first color and four of said nine regions comprise a second color;

fifteen of said 135 small game pieces comprise said first color, fifteen of said 135 small game pieces comprise said second color, fifteen of said 135 small game pieces comprise said third color, fifteen of said 135 small game pieces comprise a fourth color, fifteen of said 135 small game pieces comprise said fifth color, fifteen of said 135 small game pieces comprise said sixth color, fifteen of said 135 small game pieces comprise said seventh color, fifteen of said 135 small game pieces comprise said eighth color and fifteen of said 135 small game pieces comprise said ninth color;

said small game pieces of said first color include indicia corresponding to the number '1', said small game pieces of said second color include indicia corresponding to the number '2', said small game pieces of said third color include indicia corresponding to the number '3', said small game pieces of said fourth color include indicia corresponding to the number '4', said small game pieces of said fifth color include indicia corresponding to the number '5', said small game pieces of said sixth color include indicia corresponding to the number '6', said small game pieces of said seventh color include indicia corresponding to the number '7', said small game pieces of said eighth color include indicia corresponding to the number '8' and said small game pieces of said ninth color include indicia corresponding to the number '9'.

* * * * *